US006459408B1

(12) United States Patent
Kubo et al.

(10) Patent No.: US 6,459,408 B1
(45) Date of Patent: Oct. 1, 2002

(54) SATELLITE RECEIVER AND METHOD AND APPARATUS FOR ADJUSTING THE DIRECTION OF SATELLITE DISH ANTENNA

(75) Inventors: Hiroaki Kubo, Ohmihachiman; Masahiro Murakami, Kyoto, both of (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/697,440

(22) Filed: Oct. 26, 2000

(30) Foreign Application Priority Data

Oct. 28, 1999 (JP) ..... 11-307241

(51) Int. Cl.[7] ..... H01Q 3/00
(52) U.S. Cl. ..... 342/359; 343/761
(58) Field of Search ..... 342/359; 343/761, 343/703

(56) References Cited

U.S. PATENT DOCUMENTS 4,990,924 A * 2/1991 McMullen et al. ..... 342/359

6,144,692 A * 11/2000 Beck ..... 375/130

* cited by examiner

*Primary Examiner*—Theodore M. Blum
(74) *Attorney, Agent, or Firm*—Lawrence D. Cutter, Esq.; Kevin P. Radigan, Esq.; Heslin Rothenberg, Farley & Mesiti P.C.

(57) ABSTRACT

An object of the present invention is to inform a person who adjusts the direction of an antenna 70 of the intensity of a signal received by the antenna 70 without connecting or adding special equipment to the antenna 70 or a connection cable 74.

The satellite receiver 20 comprises: a received intensity information outputting means 22 for outputting received intensity information describing the intensity of a signal received from the antenna 70; a modulating means 30 for superimposing the received intensity information on a carrier wave; and a superimposing means 40 for superimposing the carrier wave carrying the received intensity information on a connection cable 74.

18 Claims, 6 Drawing Sheets

SATELLITE RECEIVER AND METHOD AND APPARATUS FOR ADJUSTING THE DIRECTION OF SATELLITE DISH ANTENNA

RELATED PATENT APPLICATION

This application claims priority from Japanese patent application number 11-307241, filed Oct. 28, 1999, which is hereby incorporated herein by reference in its entirety.

BACKGROUND OF THE INVENTION

1. Field of the Invention

The present invention relates to a method and apparatus for adjusting the direction of a satellite dish antenna, and a satellite receiver having a function to assist adjustment of the direction of a satellite dish antenna.

2. Description of Related Art

In order to receive a satellite broadcast signal from broadcasting satellite (BS) or communications satellite (CS), it is necessary to install a satellite receiver and a satellite dish antenna. In general, a parabolic antenna is used as the satellite dish antenna. The parabolic antenna receives a signal from a satellite, and a satellite receiver takes images and sounds from the received signal and then transfers them to an output device such as a television and a speaker.

In general, a parabolic dish antenna has very strong directivity. For this reason, when the direction of the parabolic dish antenna is displaced by approximately 2 degrees, the output to the satellite receiver is reduced to half or less. The reduction of output to the satellite receiver causes a harmful effect such as distortion of images and sounds, and in the worst case it may cause the receiver failure. Therefore, accurate adjustment of the direction of the antenna such as an elevation angle, a horizontal angle and a polarization angle is necessary. Rough adjustment of the direction is made first by using graduations provided on the antenna and then fine adjustment is made. Most of currently available satellite receivers have a function to display the intensity of a signal received by the antenna as a numerical value or a bar graph on a display screen of a television or the like. Alternatively, the intensity of a signal received by the antenna may be given as a sound volume output from a built-in speaker of the television or the like. The direction of the antenna is adjusted by using such a function of the receiver so that the signal received by the antenna can attain the maximum intensity.

FIG. 6 shows the structure of a satellite receiver 80 and an example of connection between a parabolic dish antenna 70 and an output device 76, but FIG. 6 mainly shows a part associated with the adjustment of the direction of the parabolic dish antenna 70. The parabolic dish antenna 70 is connected to the satellite receiver 80 through a connection cable 74. A coaxial cable is generally used as the connection cable 74. Between the parabolic dish antenna 70 and the connection cable 74, a low noise block converter (LNB) 72 is disposed. The LNB 72 has a function of, for example, converting a received signal having a frequency band of 10 GHZ into a signal having a band frequency of 1 GHz. The satellite receiver 80 includes a tuner 82, an automatic gain control (AGC) 84, a microprocessing unit (MPU) 86 and an output processing unit 88.

The tuner 82 tunes the television to a channel of a desired broadcast program. The 1 GHz signal received from the LNB 72 through the connection cable 74 is sent from the tuner 82 to the AGC 84. The AGC 84 generates an output in accordance with the received signal as well as stabilizes the output through gain control. The output of the AGC 84 is substantially in proportion to the intensity of a signal received by the antenna. Therefore, the output of the AGC 84 can be used as an index for adjusting the direction of the antenna 70. For example, the direction of the parabolic dish antenna 70 is adjusted so as to maximize the output of the AGC 84. The amplitude of the output of the AGC 84 can be measured with a measuring device such as a tester, which most homes do not own. Accordingly, in many cases, a numerical value corresponding to the amplitude of the output of the AGC 84 is displayed on the television screen or a sound in accordance with the amplitude of the output of the AGC 84 is output from the speaker. The output device 76 such as a television and a speaker is connected to the satellite receiver 80 through an output cable 78.

The output of the AGC 84 is input to the MPU 86. The MPU 86 outputs a received intensity signal in accordance with the output of the AGC 84. The received intensity signal used herein is obtained by converting the output of the AGC 84 into a numerical value ranging from 1 to 30. The output processing unit 88 converts the received intensity signal into an image signal or a sound signal. The image signal is output to the television screen or the like, and the sound signal is output to the speaker or the like. The image signal is used, for example, for displaying the numerical value (1 to 30) corresponding to the received intensity signal as a numerical character or a bar graph. The sound signal is used, for example, for changing the frequency or the volume of a sound to be output in accordance with the numerical value (1 to 30) corresponding to the received intensity signal. Based on the image displayed on the television screen or the sound output from the speaker, the direction of the antenna 70 is adjusted so as to maximize the intensity of the signal received by the antenna 70.

However, these adjustments are made only by peripheral equipment of the satellite receiver 80. In order to display the received intensity on the television screen, the television screen should be seen from a place where the parabolic dish antenna is installed. For example, in the case where the antenna is installed near the window of a room where the satellite receiver is placed and the television screen can be seen from the place where the antenna is installed, the direction can be easily adjusted. However, in the case where the antenna is installed, for example, on the roof, the television screen cannot be seen from the place where the antenna is installed, and therefore the direction of the antenna cannot be accurately adjusted.

In such a case, the direction is generally adjusted by two persons: one is an adjuster of the direction; and the other is an instructor for instructing the adjuster on the direction while watching the television screen. In this case, however, it is difficult to make fine and accurate adjustment of the antenna to an optimal direction. In general, an antenna is installed outdoors on the roof of a house or a building, and the satellite receiver is installed indoors near a television. Thus, in many cases a satellite receiver is away from an antenna. When the direction is thus adjusted by two persons, the adjuster sometimes cannot hear the voice of the instructor. Similarly, when the received intensity is output from the speaker, the adjuster sometimes cannot hear the output sound.

A reliable method of seeing the television screen without fails is to bring a compact television and the satellite receiver near the antenna so that the direction can be adjusted while checking the image displayed on the television screen. However, this method requires a compact television, and it is necessary to bring the compact television and the satellite receiver to the place where the antenna is installed, for example, to the roof, which entails danger. In addition, since a coaxial cable for connecting the receiver to the antenna is already. installed, an additional coaxial cable has to be prepared to be connected to the satellite receiver moved to the place for installing the antenna when the readjustment of direction of the antenna is required.

On the other hand, an expert in installing an antenna uses special equipment for measuring the intensity of the received signal. In most of such equipment, the intensity of the signal received by the antenna is displayed as a numerical value or a bar graph on the screen. This equipment is connected to the end terminal of the antenna (LNB), and the direction of the antenna is adjusted so as to maximize the intensity of the received signal measured with this equipment. Since this equipment is driven by a battery and hence is portable, it can be used in any place for adjusting the direction of the antenna. However, this equipment is quite expensive because of its specialty.

Thus, it is difficult for a general user to accurately adjust the direction of an antenna. In order to accurately adjust the direction, it is necessary to prepare or purchase special equipment necessary for the direction adjustment. In addition, when an antenna alone is purchased through mail order or the like, it is difficult for the purchaser to arrange an expert in its installation, so that the antenna should be installed by the purchaser himself/herself. Moreover, the direction of an antenna should be readjusted when, for example, the angle of the antenna is shifted due to strong wind or the like.

SUMMARY OF THE INVENTION

An object of the present invention is to inform a person who adjusts the direction of an antenna of the intensity of a signal received by the antenna without connecting or adding special equipment to the antenna or a connection cable.

The method of adjusting the direction of a satellite dish antenna according to the present invention comprises the steps of: outputting received intensity information in accordance with the. intensity of a signal received from the satellite dish antenna; superimposing the received intensity information on a carrier wave; superimposing the carrier wave carrying the received intensity information on a connection cable; and receiving the received intensity information leaked from the connection cable.

The satellite receiver of the present invention comprises: means for outputting received intensity information in accordance with the intensity of a signal received from a satellite dish antenna; means for superimposing the received intensity information on a carrier wave; and superimposing the carrier wave carrying the received intensity information on a connection cable.

The apparatus for adjusting the direction of a satellite dish antenna according to the present invention comprises: means for superimposing received intensity information in accordance with the intensity of a signal received from the satellite dish antenna on a carrier wave; and means for superimposing the carrier wave carrying the received intensity information on a connection cable.

DESCRIPTION OF THE PREFERRED EMBODIMENTS

Now, a preferred embodiment of a satellite receiver and a method of adjusting the direction of a satellite dish antenna according to the invention will be described in detail with reference to the accompanying drawings.

Figure 1:
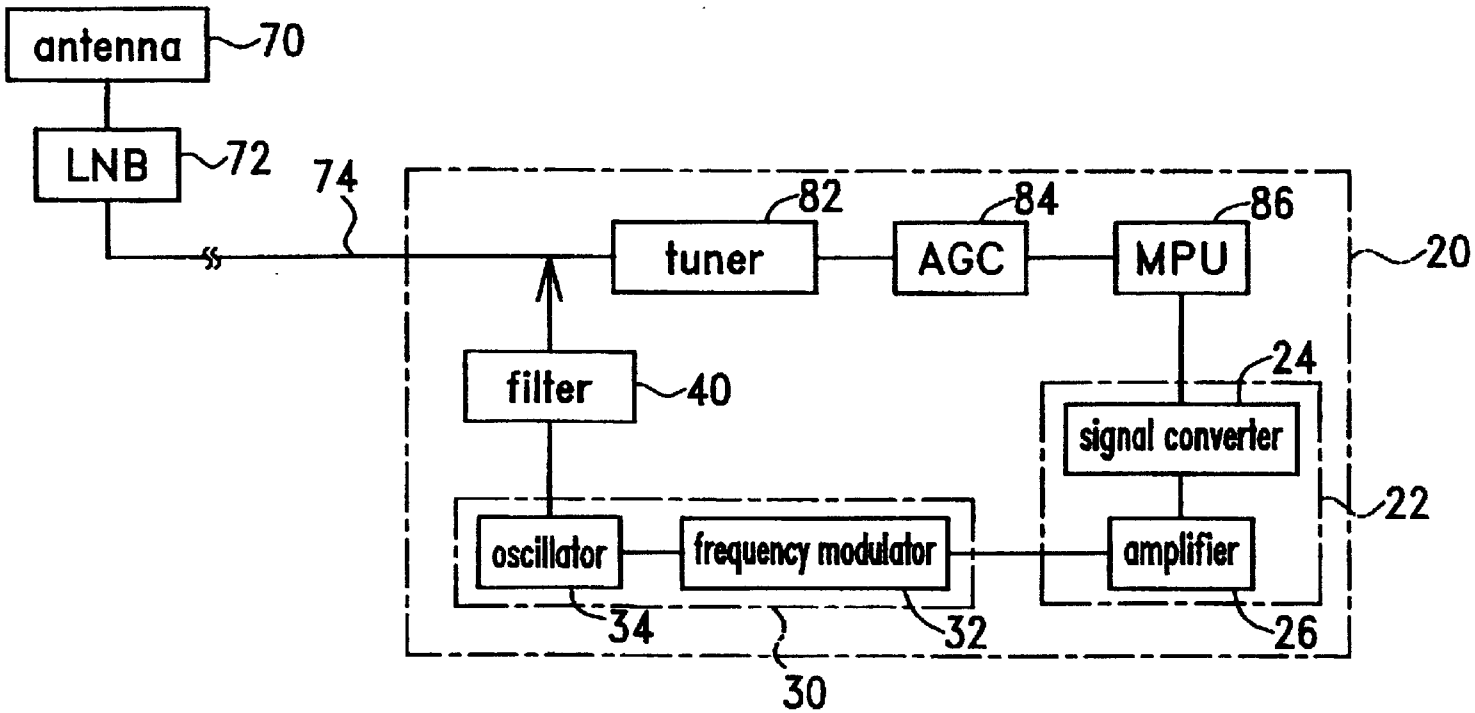
FIG. 1 is a block diagram showing an example of the satellite receiver according to the present invention.

FIG. 1 shows an example of the satellite receiver according to the present invention. FIG. 1 mainly shows a part associated with adjustment of the direction of the antenna. The satellite receiver 20 includes audible signal output means 22, frequency modulating means 30 and superimposing means 40. An antenna 70, an LNB 72, a connection cable 74, a tuner 82, an AGC 84 and an MPU 86 may be the same as those used in the conventional technique.

The audible signal output means 22 outputs a sound signal or an effect sound responsive to the intensity of a signal received by the antenna 70 on the basis of the output of the MPU 86. The means 22 includes a signal converter 24 and an amplifier 26. The converter 24 converts a received intensity signal input from the MPU 86 into an audible signal. The received intensity signal is obtained by, for example, converting the output of the AGC 84 into a numerical value ranging from 1 to 30. The audible signal is a sound signal for informing a person who installs the antenna of the intensity of the received signal, and it can be a sound whose frequency is increased with the received intensity signal, a melody for informing that the received intensity signal has become a predetermined value or more, or a voice for reading out a numerical value corresponding to the received intensity signal. The amplifier 26 amplifies the audible signal to an operating level of the frequency modulating means 30.

The frequency modulating means 30 modulates the frequency of the audible signal. The frequency modulating means 30 includes an oscillator 34 and a frequency modulator 32. The oscillator 34 is a sine wave generator for generating a carrier wave of a predetermined frequency. The frequency of the oscillator 34 can be set to 80 MHz, for example. There are a variety of FM (frequency modulation) broadcast stations all over the country these days, and various frequencies are used. For this reason, it is preferred that the frequency of the oscillator 34 can be selected from several frequencies. The frequency modulator 32 converts a change of the amplitude of the audible signal into a change of a frequency. In general, the frequency band attained after the conversion is within approximately ±(20 KHz to 50 KHz) from the center frequency (80 MHz).

Figure 2:
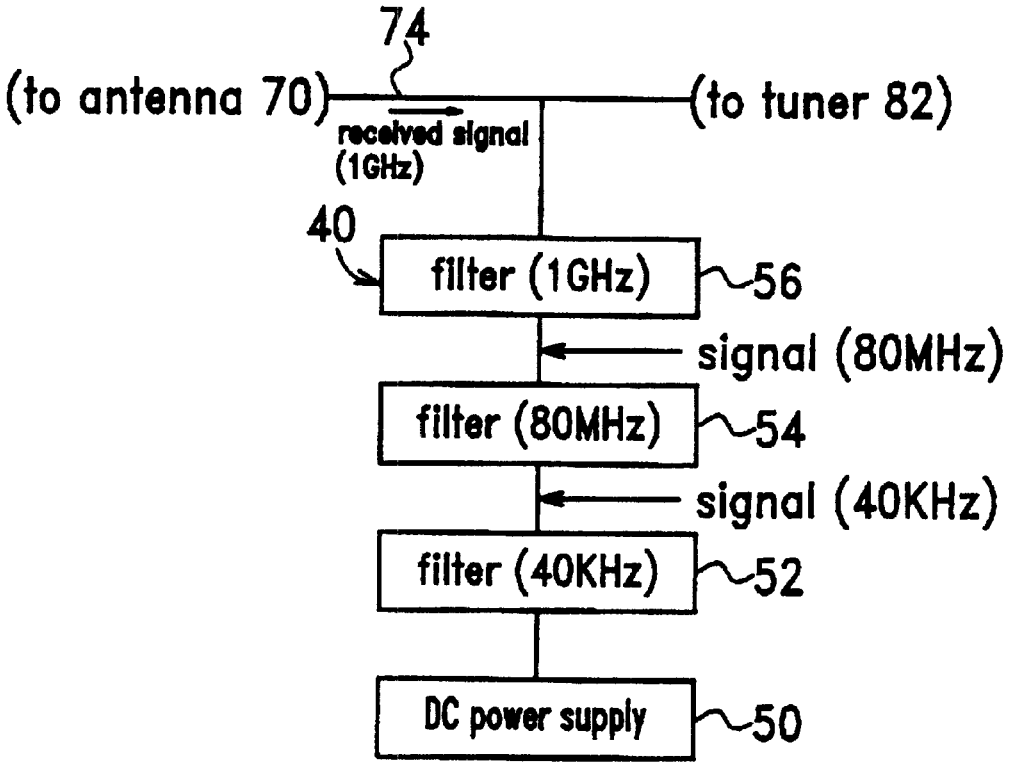
FIG. 2 is a block diagram showing an example of the filter included in superimposing means of the satellite receiver shown in FIG. 1.

The superimposing means 40 superimposes the modulated carrier wave on the connection cable 74 without affecting other signals transferred through the cable. The superimposing means 40 includes a filter. The filter cuts predetermined frequency components from the carrier wave without affecting the other signals such as a satellite received signal transmitted through the connection cable 74. The specific structure of the superimposing means 40 is shown in FIG. 2. The superimposing means 40 includes filters 52, 54 and 56. The filter 52 cuts frequencies of 40 KHz or more, the filter 54 cuts frequencies of 80 MHz or more, and the filter 56 cuts frequencies of 1 GHz or more.

Through the connection cable 74, a received signal and a power signal are mainly transmitted. The received signal is a signal including frequencies from 950 MHz to 2150 MHz, which is transferred from the antenna 70 and the LNB 72 to the satellite receiver 20. The power signal is a DC current of 10 to 15 V for driving the LNB 72, and is supplied from a DC power supply 50 included in the satellite receiver 20. Additionally, a square wave, sine wave, or similar wave of signal, which has a frequency of 40 KHz and a peak-to-peak value of 0.6 V, is transmitted through the connection cable 74 so as to distinguish a satellite. FIG. 2 shows the received signal (1 GHz), the carrier wave (80 MHz) and the signal (40 KHz) for distinguishing a satellite and the DC power supply 50.

As shown in FIG. 2, the filters 52, 54 and 56 are used to superimpose the aforementioned carrier wave of a frequency of approximately 80 MHz without affecting these signals. Between the DC power supply 50 and the connection cable 74, the filters 52, 54 and 56 are disposed in this order along a direction from the power supply 50 to the connection cable 74. The 40 KHz signal is superimposed between the filters 52 and 54, the signal of 80 MHz is superimposed between the filters 54 and 56.

The power signal passes through the filters 52, 54 and 56 and flows into the connection cable 74. The 40 KHz signal does not flow into the power supply 50 due to the filter 52, but it passes through the filters 54 and 56 and flows into the connection cable 74. In this case, however, a frequency component exceeding 80 MHz is cut by the filter 54. The 80 MHz signal does not flow into the power supply 50 due to the filter 54, but it passes through the filter 56 and flows into the connection cable 74. In this case, however, a frequency component exceeding 1 GHz is cut by the filter 56. The 1 GHz signal does not flow into the power supply 50 due to the filter 56. Thus, the filters 52, 54 and 56 can prevent each of these signals from affecting the other signals of the different frequencies and other devices.

Although not shown in the drawing, the satellite receiver 20 includes an antenna adjusting mode switch. The switch can be provided on a front panel of the satellite receiver 20, for example. When this switch is turned on, the signal converter 24, the amplifier 26, the frequency modulator 32, the oscillator 34 and the like are actuated. In the adjustment of the direction of the antenna, this switch is turned on.

Next, the adjustment of the direction of the antenna using the satellite receiver 20 and the method of adjusting the direction of the satellite antenna will be described.

Before the adjustment, the antenna adjusting mode switch is turned on. When the switch is turned on, the signal converter 24, the amplifier 26, the frequency modulator 32, the oscillator 34 and the like are actuated. The signal converter 24 outputs an audible signal responsive to the intensity of a received signal on the basis of the output of the MPU 86. The audible signal is amplified by the amplifier 26 to the operating level of the frequency modulator 32. The frequency modulator 32 changes the frequency of a carrier wave generated by the oscillator 34 in accordance with the amplitude of the audible signal. The filter (40) cuts predetermined frequency components from the frequency-modulated carrier wave, and then the resultant carrier wave is superimposed in the connection cable 74. A high frequency current of 80 MHz, which does not affect a high frequency current of 1 GHz to 2 GHz sent from the parabolic dish antenna 70, flows through the connection cable 74. At this time, change of characteristic impedance of the end portion of the cable 74 on the side of the LNB 72 and characteristic impedance of the cable 74 itself generates a standing wave in the cable 74.

Figure 3:
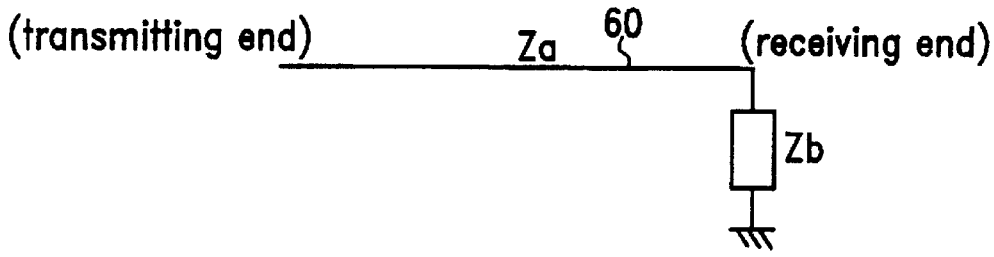
FIGS. 3(*a*) to 3(*c*) are explanatory views of a standing wave.
Figure 3:
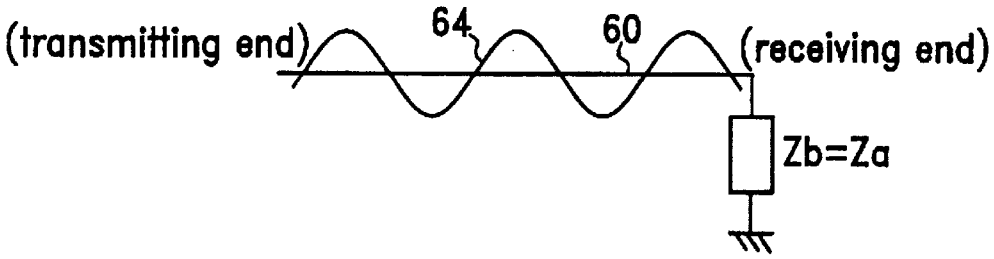
Figure 3:
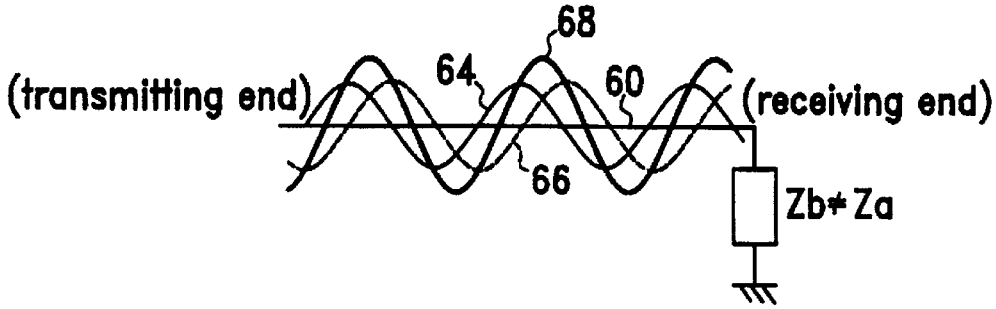

A standing wave is generated when a high frequency signal is passed through a transmission path, because the wavelength of the signal is shorter than that of the transmission path. For example, as shown in FIG. 3(*a*), when the receiving end of a transmission path 60 of characteristic impedance Za is short-circuited by characteristic impedance Zb, no signal will be reflected at the receiving end as far as the impedance Za is matched to impedance Zb. In this case, only a progressive wave 64 traveling from the transmitting end to the receiving end is present on the transmission path 60. However, when the impedances Za and Zb are not matched and different from each other, the signal is reflected at the receiving end. In this case, both the progressive wave 64 and a reflected wave 66 are present at the same time on the transmission path 60 as shown in FIG. 3(*c*). The progressive wave 64 and the reflected wave 66 mutually interfere on the transmission path 60, which generates a wave apparently not moving, namely, a standing wave 68. When the standing wave 68 is generated, a signal flowing through the transmission path 60 leaks out of the transmission path 60 as a weak high frequency signal, so that the signal flowing through the transmission path 60 can be sent to an external receiver not connected to the transmission path.

Figure 4:
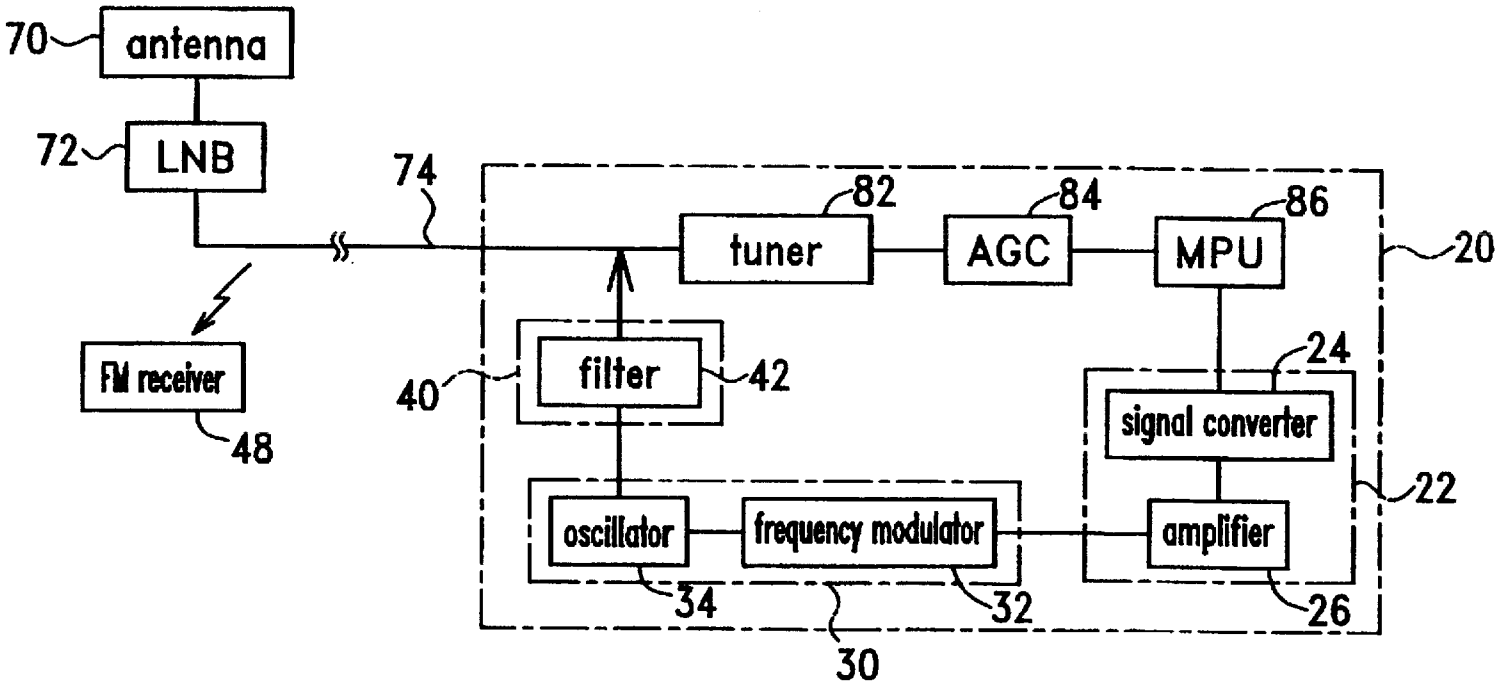
FIG. 4 is a block diagram showing reception of a leaked wave from a connection cable in the satellite receiver shown in FIG. 1.

A general satellite receiver and a general satellite antenna are provided with a matching circuit (not shown) at the end portion of the connection cable 74. The matching circuit conducts matching on frequencies in the vicinity of 1 GHz for avoiding reflection. Accordingly, a satellite received signal will not be reflected, and a standing wave will not be generated. However, the matching is not conducted on signals of other frequencies, and hence, a standing wave is generated. Due to this standing wave, a high frequency current that is originally not radiated is radiated to the outside of the connection cable 74 as shown in FIG. 4, which can be received by an external receiver 48 as a leaked wave. Similar phenomenon is also observed in the LNB 72, and hence, a leaked wave radiated from the LNB 72 can be received.

In this embodiment, since the frequency-modulated (FM) audible signal of 80 MHz is superimposed on the connection cable 74, the 80 MHz audible signal can be received by the FM broadcast receiver 48 such as an FM radio as shown in FIG. 4. An FM radio and audio equipment with an FM radio function are widely used, and therefore, the direction of the antenna 70 can be adjusted while listening to the audible signal in the same manner as in listening to FM broadcast.

The leaked wave is much smaller than the high frequency current flowing through the cable 74. Therefore, the leaked wave can be received only in the vicinity of the connection cable 74. The range where the leaked wave is received can be controlled by changing the amplitude of the high frequency current flowing through the cable 74. However, since a person who adjusts the direction of the antenna 70 is near the antenna 70 and the connection cable 74, he/she can receive it without any difficulties. The amplitude of the high frequency current flowing through the cable 74 should be such that the leaked wave can be received by an FM radio outside the cable 74. However, it should be such that the leaked wave does not interfere with other equipments or receipt of broadcast and that the radiated current does not exceed a standard value.

In this manner, the small FM high frequency current including the received intensity information can be superimposed on the connection cable 74, which connects the antenna 70 and the receiver 20, without affecting the satellite received signal. The intensity of a signal currently received by the antenna 70 can be audibly known by receiving the leaked wave of the FM high frequency current radiated from the connection cable 74 by an FM radio. Thus, without modifying the antenna 70 and the cable 74, the direction of the parabolic dish antenna 70 can be accurately adjusted on the basis of the sound output from the FM radio.

Figure 5:
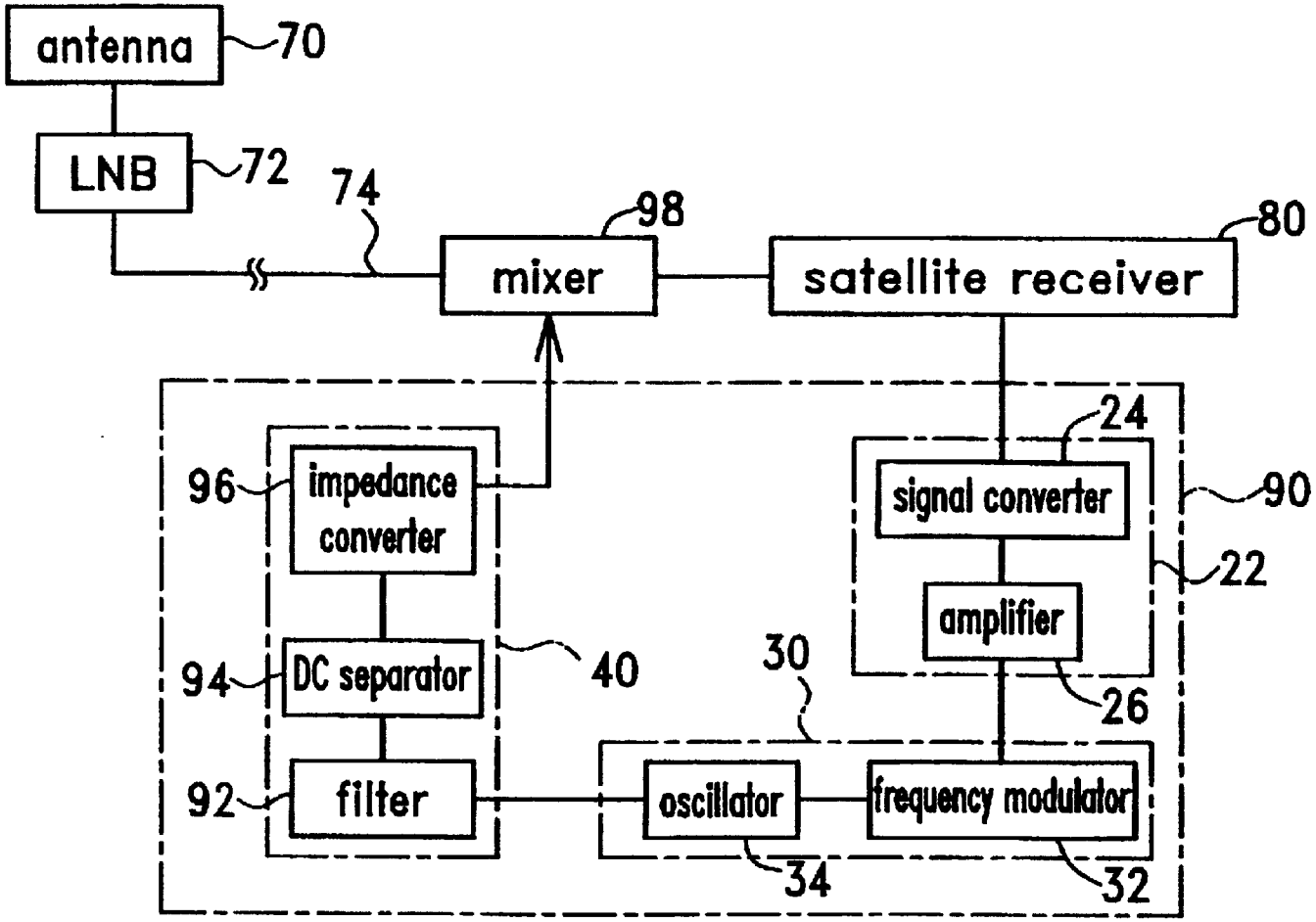
FIG. 5 is a block diagram showing an embodiment of a direction adjustment apparatus for a satellite dish antenna according to the present invention.
Figure 6:
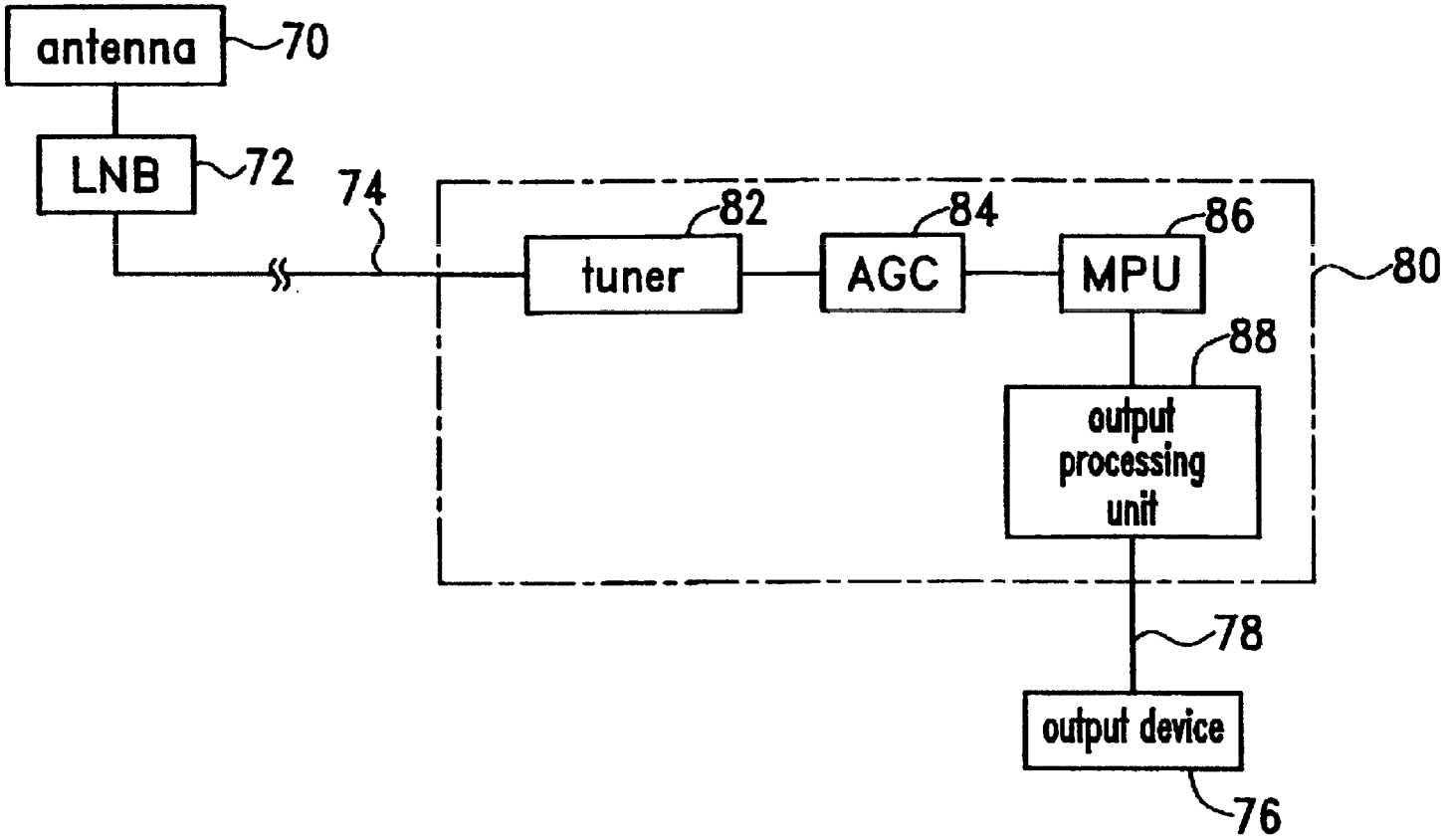
FIG. 6 is a block diagram showing an example of a conventional satellite receiver.

The audible signal output means 22, the frequency modulating means 30 and the superimposing means 40 may be externally provided to the satellite receiver 80 as shown in FIG. 5. A direction adjusting device 90 for a satellite dish antenna, which is external to the receiver 80, includes audible signal output means 22, frequency modulating means 30 and superimposing means 40. It also includes, although not shown in the drawing, a power unit for supplying power to the audible signal output means 22, the frequency modulating means 30 and the superimposing means 40. The power unit obtains electric power from a battery or a plug socket through a power code. The audible signal output means 22 includes a signal converter 24 and an amplifier 26. When the output of the MPU 86 is taken out of the satellite receiver 80, the output of the MPU 86 is input to the signal converter 24. When the output of the MPU 86 cannot be taken out of the receiver 80, the output of an output processing unit 88 (shown in FIG. 6) is input to either the amplifier 26 or the signal converter 24. The frequency modulating means 30 includes a frequency modulator 32 and an oscillator 34.

The superimposing means 40 includes a filter 92, a DC separator 94 and an impedance converter 96. The filter 92 allows only a frequency component (in the vicinity of 80 MHz) of a carrier wave carrying the received intensity information to pass therethrough. The DC separator 94 cuts a DC component and allows an AC component alone to pass therethrough. The impedance converter 96 converts impedance in accordance with that of the connection cable 74 (a coaxial cable with characteristic impedance of 75 Ω). The output of the superimposing means 40 is input to a mixer 98 disposed between the LNB 72 and the satellite receiver 80, and then superimposed on the connection cable.

When the direction adjusting device 90 for the satellite dish antenna is thus externally provided to the satellite receiver 80 and the mixer 98, the small FM high frequency current including the received intensity information can be superimposed on the connection cable 74, which connects the antenna 70 and the receiver 80, without affecting a satellite received signal. The intensity of a signal currently received by the antenna 70 can be audibly known by receiving the leaked wave of the FM high frequency current radiated from the connection cable 74 by an FM radio.

As can be seen from the above, the present invention superimposes received intensity information on a connection cable such that one can receive by a radio receiver the received intensity information leaked from the connection cable. Thus, a person who installs the antenna can adjust the direction of the antenna while checking the intensity information received by the receiver without connecting or adding special equipment to the antenna or a connection cable One embodiment of the present invention has thus been described, but the present invention can be practiced in other embodiments. For example, a modulator for superimposing the received intensity information on a carrier wave is not limited to a frequency modulator with a center frequency of 80 MHz. The center frequency can be set to any frequency which can be received by an FM receiver. The range of frequency which can be received by most of commercially available FM radios is 70 MHz to 100 MHz, and hence, the center frequency can be set within this range.

Most FM radios have an AM (amplitude modulation) radio function. AM radios as well as FM radios are widely used. Accordingly, the frequency modulator can be replaced with an amplitude modulator. While receiving by an AM radio the received intensity information whose amplitude is modulated, one can adjust the direction of the antenna.

On the assumption that a user does not own an FM radio but owns an AM radio, both the functions of frequency modulation and amplitude modulation can be provided. When both of these functions are provided, the frequency modulation (FM) or the amplitude modulation (AM) can be selected in accordance with the radio owned by a user.

The received intensity information can be modulated by using a modulation method in accordance with a receiver prepared by a user. Accordingly, in the case where a receiver using phase modulation is widely used among users, the received intensity information can be phase-modulated to be superimposed on the connection cable. The received intensity information is not limited to an audible signal. In the case where a portable television is widely used among users, an image signal can be used as the received intensity information.

While the embodiments of the present invention have thus been described with reference to the drawings, it should be understood that the present invention be not limited to the embodiments shown in the drawings. Many changes, modifications, and variations can be made to the embodiments on the basis of knowledge of those skilled in the art without departing from the scope of the present invention.

What is claimed is:

1. A method of facilitating adjusting the direction of a satellite dish antenna which is connected to a satellite receiver through a connection cable, comprising:

outputting received intensity information in accordance with the intensity of a signal received from the satellite dish antenna;

superimposing the received intensity information on a carrier wave;

superimposing the carrier wave carrying the received intensity information on a connection cable; and obtaining the received intensity information via a signal leaked from the connection cable resulting from a formation of a standing wave in the connection cable, thereby facilitating adjusting the direction of the satellite dish antenna.

2. The method according to claim 1, wherein said superimposing the received intensity information on a carrier wave comprises modulating the carrier wave in accordance with the received intensity information.

3. The method according to claim 2, wherein said modulating the carrier wave comprises modulating the frequency of the carrier wave in accordance with the received intensity information.

4. The method according to claim 1, wherein said superimposing the carrier wave carrying the received intensity information on a connection cable comprises cutting a frequency component included in a frequency band of the received signal from the carrier wave.

5. A satellite receiver which is connected to a satellite dish antenna through a connection cable, comprising:

means for outputting received intensity information in accordance with the intensity of a signal received from the satellite dish antenna;

means for superimposing the received intensity information on a carrier wave; and means for superimposing the carrier wave carrying the received intensity information on a connection cable for the purpose of producing a standing wave in the connection cable, thereby resulting in a signal leaked from the connection cable, wherein said leaked signal may be used to facilitate adjusting the direction of a satellite dish antenna.

6. The satellite receiver according to claim 5, wherein said received intensity information includes an audible signal.

7. The satellite receiver according to claim 5, wherein said means for superimposing the received intensity information on a carrier wave comprises modulating means for modulating the carrier wave in accordance with the received intensity information.

8. The satellite receiver according to claim 7, wherein said modulating means comprises frequency modulating means for changing the frequency of the carrier wave in accordance with the received intensity information.

9. The satellite receiver according to claim 8, wherein said frequency is in the rage of 70 MHz to 100 MHz.

10. The satellite receiver according to claim 5, wherein said means for superimposing the carrier wave carrying the received intensity information on a connection cable comprises a filtering circuit for cutting a frequency component included in a frequency band of the received signal from the carrier wave.

11. The satellite receiver according to claim 5, further comprising a operating switch for operating said means for outputting received intensity information in accordance with the intensity of a signal received from the satellite dish antenna, said means for superimposing the received intensity information on the carrier wave, and said means for superimposing the carrier wave carrying the received intensity information on a connection cable.

12. An apparatus for facilitating adjusting the direction of a satellite dish antenna, which is connected to a satellite receiver and a connection cable connecting the satellite receiver and the satellite dish antenna, comprising:

means for superimposing received intensity information in accordance with the intensity of a signal received from the satellite dish antenna on a carrier wave; and means for superimposing the carrier wave carrying the received intensity information on the connection cable for the purpose of producing a standing wave in the connection cable, thereby resulting in a signal leaked from the connection cable, wherein said leaked signal may be used to facilitate adjusting the direction of a satellite dish antenna.

13. The apparatus according to claim 12, wherein said received intensity information includes an audible signal.

14. The apparatus according to claim 12, wherein said means for superimposing the received intensity information on a carrier wave comprises a modulating means for modulating the carrier wave in accordance with the received intensity information.

15. The apparatus according to claim 14, wherein said modulating means comprises frequency modulating means for changing the frequency of the carrier wave in accordance with the received intensity information.

16. The apparatus according to claim 15, wherein said frequency is in the range of 70 MHz to 100 MHz.

17. The apparatus according to any one of claim 12, wherein said means for superimposing the carrier wave carrying the received intensity information on the connection cable comprises a filtering circuit for cutting a frequency component included in a frequency band of the received signal from the carrier wave.

18. The apparatus according to any one of claim 12, further comprising means for receiving received intensity information leaked from the connection cable.

* * * * *